US009661956B2

(12) United States Patent
Geels

(10) Patent No.: US 9,661,956 B2
(45) Date of Patent: May 30, 2017

(54) METHOD OF FORMING A BATHING VESSEL

(75) Inventor: Michael Glenn Geels, Jackson, TN (US)

(73) Assignee: Delta Faucet Company, Indianapolis, IN (US)

( * ) Notice: Subject to any disclaimer, the term of this patent is extended or adjusted under 35 U.S.C. 154(b) by 1006 days.

(21) Appl. No.: 13/883,619

(22) PCT Filed: Sep. 2, 2011

(86) PCT No.: PCT/US2011/050352

§ 371 (c)(1),
(2), (4) Date: May 6, 2013

(87) PCT Pub. No.: WO2012/067696

PCT Pub. Date: May 24, 2012

(65) Prior Publication Data

US 2013/0219610 A1 Aug. 29, 2013

Related U.S. Application Data

(60) Provisional application No. 61/413,575, filed on Nov. 15, 2010.

(51) Int. Cl.

| | |
|---|---|
| ***A47K 3/022*** | (2006.01) |
| ***A47K 3/04*** | (2006.01) |
| ***A47K 3/02*** | (2006.01) |
| ***A47K 3/30*** | (2006.01) |
| ***B05D 3/12*** | (2006.01) |
| ***A47K 3/16*** | (2006.01) |

(52) U.S. Cl.
CPC ..... *A47K 3/04* (2013.01); *A47K 3/02* (2013.01); *A47K 3/16* (2013.01); *A47K 3/30* (2013.01); *B05D 3/12* (2013.01); *Y10T 29/49* (2015.01); *Y10T 29/49826* (2015.01)

(58) Field of Classification Search
USPC ..... 4/421, 425
See application file for complete search history.

(56) References Cited

U.S. PATENT DOCUMENTS

| | | | | |
|---|---|---|---|---|
| 5,320,879 | A * | 6/1994 | Bullock | C23C 4/06 427/128 |
| 6,337,103 | B1 | 1/2002 | Inoue et al. | |
| 2005/0276941 | A1 | 12/2005 | Kapelanski et al. | |
| 2005/0281997 | A1 * | 12/2005 | Grah | B32B 7/02 428/215 |

OTHER PUBLICATIONS

International Preliminary Report on Patentability for International Application No. PCT/US2011/050352 completed on May 21, 2013. PCT International Search Report completed for PCT Application PCT/US2011/050352 completed Dec. 12, 2011.

* cited by examiner

*Primary Examiner* — Lauren Crane
(74) *Attorney, Agent, or Firm* — Carlson, Gaskey & Olds, P.C.

(57) ABSTRACT

A bathing vessel that includes a multi-layer structure of a first polymer layer and a second, adjacent polymer layer. Prior to formation of the second polymer layer on the first polymer layer, a surface of the first polymer layer is abraded and a surface wetting property of the surface is modified to promote bonding between the layers.

16 Claims, 2 Drawing Sheets

METHOD OF FORMING A BATHING VESSEL

RELATED APPLICATION

This application is a United States National Phase of PCT Application No. PCT/US11/50352 filed on Sep. 2, 2011, which claims priority to U.S. Provisional Application No. 61/413,575 filed on Nov. 15, 2010.

BACKGROUND

This disclosure relates to composite bathing vessels.

Bathing vessels may be manufactured from a variety of different materials, such as plastic materials. Plastic bathing vessels, however, must meet certain minimum performance requirements. For instance, the American National Standards Institute (ANSI) sets forth minimum physical requirements and testing methods for plastic bathtub and shower units. A bathing vessel that meets the relevant requirements may be approved for use in homes, buildings or other structures as a plumbing fixture.

SUMMARY

An exemplary bathing vessel includes a multi-layer structure of a first polymer layer and a second, adjacent polymer layer includes. Prior to formation of the second polymer layer on the first polymer layer, a surface of the first polymer layer is abraded and a surface wetting property of the surface of the first polymer layer is modified to promote bonding between the layers. The first polymer layer may be a layer of acrylonitrile butadiene styrene and the second polymer layer may be a layer of polyurethane material.

An exemplary bathing vessel includes a base and at least one wall extending vertically from the base. The wall includes a multi-layer structure of a first polymer layer bonded to an adjacent second polymer layer. The first polymer layer defines a first side and an opposite, second side. The second side is bonded to the second polymer layer. The first side has a first surface roughness and the second side has a second surface roughness that is greater than the first surface roughness. The second side of the first polymer layer also includes degraded polymer material from the modification of the surface wetting property.

BRIEF DESCRIPTION OF THE DRAWINGS

The various features and advantages of the disclosed examples will become apparent to those skilled in the art from the following detailed description. The drawings that accompany the detailed description can be briefly described as follows.

DETAILED DESCRIPTION OF THE PREFERRED EMBODIMENT

Figure 1:
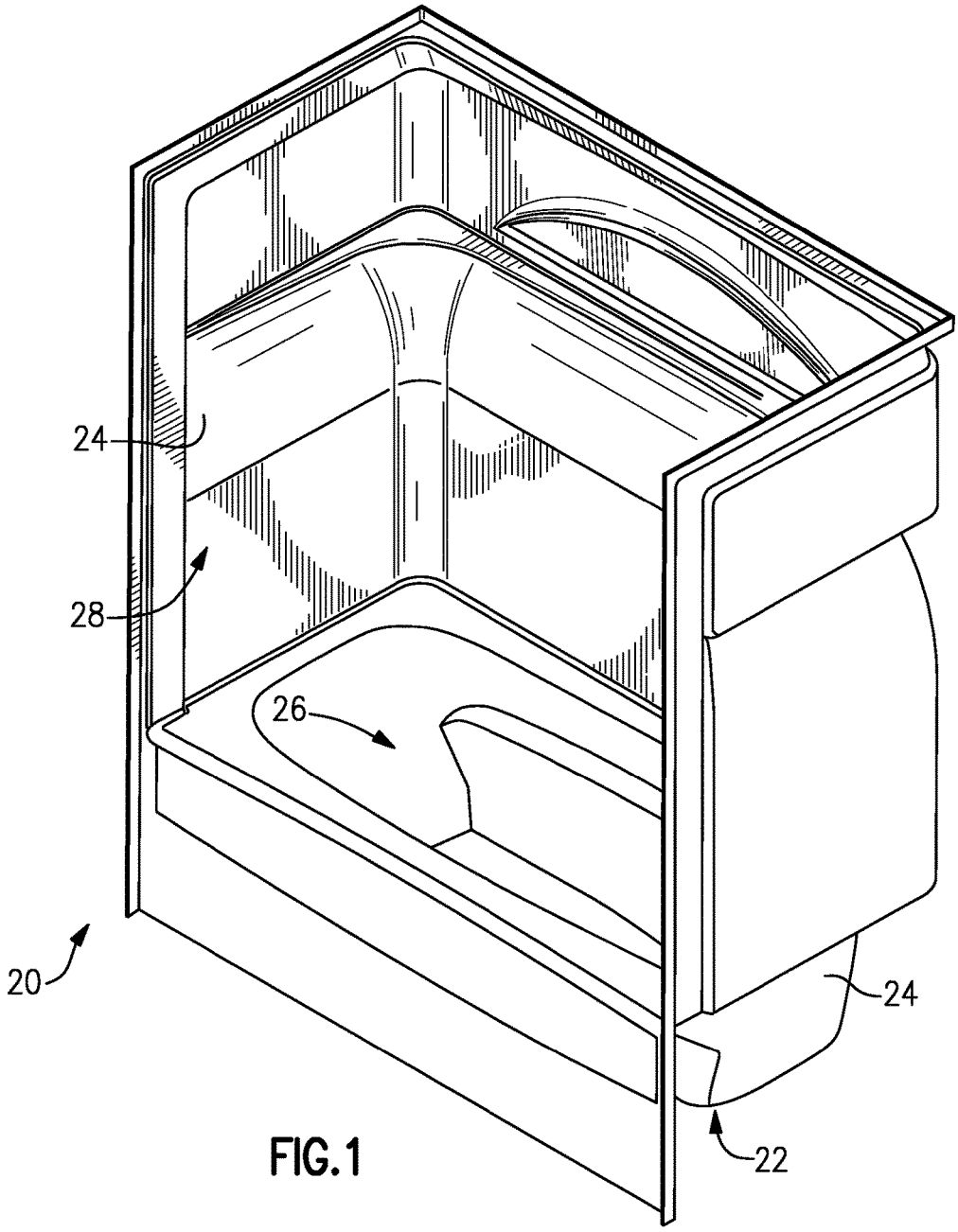
FIG. 1 shows an example composite bathing vessel.

FIG. 1 illustrates selected portions of an example bathing vessel 20. In general, the bathing vessel 20 includes a base

22 that serves as the bottom of the bathing vessel 20 and supports one or more walls 24. The walls 24 extend vertically from the base 22 to form a tub portion 26 and a shower surround portion 28. However, in alternative embodiments, the walls 24 may form only a tub portion 26 or only a shower surround portion 28 from the base 22. Thus, it is to be understood that the examples disclosed herein are not limited to the illustrated design.

Figure 2:
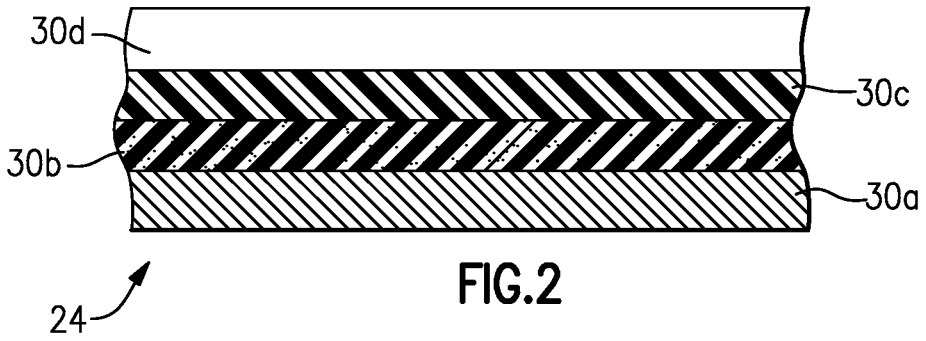
FIG. 2 shows a cross section of a multi-layer structure of a wall of a bathing vessel.

FIG. 2 shows a cross-section through a portion of one of the walls 24. The walls 24 have a multi-layer structure that generally includes a first layer of polyurethane material 30*a*, a second layer of polyurethane material 30*b*, a layer of acrylonitrile butadiene styrene (ABS) material 30*c*, and a layer of acrylic material 30*d* (collectively layers 30*a-d*), such as polymethylmethacrylate. As shown, the layer of acrylic material 30*d* is a top layer and is exposed for view to a user within the bathing vessel 20. The layers 30*b* and 30*c* are intermediate layers, and the layer 30*a* is a bottom-most layer (cap layer) that is generally obscured from view of a user within the bathing vessel 20. Each of the layers 30*a-d* is bonded to its respective neighboring layer or layers. In embodiments, the specific materials and order of the layers 30*a-d* contribute to providing the bathing vessel with a desired degree of strength, such as to meet relevant standards of the American National Standards Institute (ANSI).

In embodiments, the layer of acrylic material 30*d* is arranged on the first layer of polyurethane material 30*a*, the layer of acrylonitrile butadiene styrene (ABS) material 30*c* is arranged between the layer of acrylic material 30*d* and the first layer of polyurethane material 30*a*, and the second layer of polyurethane material 30*b* is arranged between the layer of ABS material 30*c* and the first layer of polyurethane material 30*a*. In some examples, additional layers may be arranged among the layers 30*a-d*. In other examples, the walls 24 include only the layers 30*a-d* and are free of other layers, materials, adhesives, or the like.

The thicknesses of the individual layers 30*a-d* is not necessarily shown to scale and may vary, depending on the desired wall strength and location in the wall 24, for example. In embodiments, the ratio of the thickness of the layer of acrylic material 30*d* to the thickness of the layer of ABS material is no greater than 1, to facilitate meeting strength and deflection requirements, and the combined thickness of the layer of acrylic material 30*d* and the layer of ABS material 30*c* may be between 0.01 inches and 0.3 inches In embodiments, the first layer of polyurethane material 30*a*, the second layer of polyurethane material 30*b* or both, are foamed polyurethane materials. In some examples, the density of the first layer of polyurethane material 30*a* is different than the density of the second layer of polyurethane material 30*b*. For instance, the density of the first layer of polyurethane material 30*a* is greater than the density of the second layer of polyurethane material 30*b*, to facilitate meeting strength and deflection requirements. A ratio between the density of the rigid polyurethane foam layer 30*b* and the thickness of the rigid polyurethane foam layer 30*b* is between 80-1:1.

In a further example, the second layer of polyurethane material 30*b* is a rigid layer and has a density of 1-10 pounds per cubic foot. The first layer of polyurethane material 30*a* is an elastomeric layer and has a density of about 25-65 pounds per cubic foot, though in some examples the density is approximately 55-65 pounds per cubic foot. In one example, the density is approximately 62 pounds per cubic foot.

Figure 3:
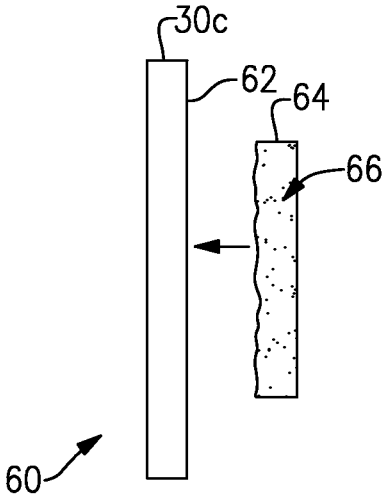
FIG. 3 illustrates an example method for forming a bathing vessel that includes modifying a surface wetting property of a polymer layer.

FIG. 3 depicts an example method 60 of forming the bathing vessel 20. As can be appreciated, the method 50 described herein may also be applied to other multi-layer structures whether there is a desire to increase bonding strength between adjacent layers. Thus, the example is of the layer of ABS material 30*c*. However, the method 60 may be applied to other polymer layers or other structures.

Prior to formation of the second polyurethane layer 30*b* on the layer of ABS material 30*c*, the surface 62 of the layer of ABS material 30*c* that is to be bonded to the second layer of polyurethane material 30*b* is abraded and modified to promote bonding between the layers 30*c* and 30*b*. For instance, the abrading enhanced mechanical bonding and the modification is to the surface wetting property to thereby enhance wetting of uncured polyurethane material on the layer of ABS material 30*c* to form the second layer of polyurethane material 30*b*.

In embodiments, the surface wetting property of the layer of ABS material 30*c* is modified through the treatment of the surface 62 with an abrasive appliance 64 and solvent 66. The abrasive appliance 64 may be an abrasive pad, such as a scouring pad. As shown, the solvent 66 is held or absorbed within the abrasive appliance 64 for simultaneous (i.e., in unison) application of abrasion and exposure to the solvent 66. Multiple passes of the abrasive appliance 64 and the solvent may be needed to suitably modify the surface 62 to increase the depth of the abrasions and penetration of the solvent.

In embodiments, the solvent may be a polar solvent, such as acetone or isopropyl alcohol. Generally, the polar solvent degrades the surface 62 of the layer of ABS material 30*c*. The interior or remaining material of the layer of ABS material 30*c* is unaffected. The degraded surface 62 enhances wetting of the uncured polyurethane material that will form the second layer of polyurethane material 30*b*, which promotes stronger bonding between the layers 30*b* and 30*c*.

Degradation of the surface 62 of the layer ABS material 30*c* also softens the material such that the abrasive appliance 64 is able to create deeper abrasions into the surface 62. For instance, the opposing side of the layer of ABS material 30*c* has a first surface roughness and the surface 62 (i.e., second side) has a second surface roughness that is greater than the first surface roughness. The deep abrasions in the surface 62 increase the surface area for contact with the uncured polyurethane material that will form the second layer of polyurethane material 30*b*.

The abrading of the surface 62 in the presence of the solvent is substantially "dust free" because, unlike dry abrading, the solvent dissolves and redistributes any removed material back onto the surface 62. Thus, the method 60 is not intended to remove much, if any, material but rather is considered to be a surface treatment for preparation of the surface 62 for bonding with the polyurethane material. The combination of the increased surface area and enhanced wetting from the degraded ABS material promotes the formation of a strong bond between the layers 30*b* and 30*c*.

Figure 4:
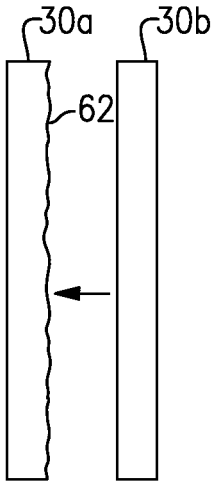
FIG. 4 illustrates forming a second polymer layer on the first polymer layer after modification of the surface wetting property as shown in FIG. 3.

As shown in FIG. 4, after modifying the surface 62 of the layer of ABS material 30*c*, uncured polyurethane material is applied to the surface 62 to form the second layer of polyurethane material 30*b* thereon.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A method of forming a bathing vessel comprising a multi-layer structure of a first polymer layer and a second, adjacent polymer layer, the method comprising:

prior to formation of the second polymer layer on the first polymer layer, modifying a surface wetting property of a surface of the first polymer layer and, in unison with the modifying, abrading the surface of the first polymer layer, to promote bonding between the surface and the second polymer layer;

wherein the modifying includes degrading the first polymer at the surface of the first polymer layer using a solvent.

2. The method as recited in claim 1, wherein the modifying and abrading of the surface of the first polymer layer includes abrading with an abrasive appliance and the solvent.

3. The method as recited in claim 2, wherein the solvent comprises acetone.

4. The method as recited in claim 2, including abrading the surface with multiple passes of the abrasive appliance and the solvent.

5. The method as recited in claim 2, wherein the solvent is absorbed in the abrasive appliance.

6. The method as recited in claim 1, wherein the degrading includes softening the surface using the solvent.

7. The method as recited in claim 1, further comprising applying an incompletely cured polymer material to the surface after modifying the surface, to form the second polymer layer.

8. The method as recited in claim 1, wherein the first polymer layer is acrylonitrile butadiene styrene (ABS) material and the second polymer layer is polyurethane material.

9. A method of forming a bathing vessel comprising a multi-layer structure of a layer of acrylonitrile butadiene styrene (ABS) material and an adjacent layer of polyurethane material, the method comprising:

prior to formation of the layer of polyurethane material on the layer of ABS material, abrading a surface of the layer of ABS material with an abrasive appliance and a polar solvent, including degrading the layer of ABS material at the surface of the layer of ABS material using the polar solvent.

10. The method as recited in claim 9, wherein the polar solvent is selected from a group consisting of acetone and isopropyl alcohol.

11. The method as recited in claim 9, wherein the polar solvent is absorbed in the abrasive appliance.

12. The method as recited in claim 9, wherein the degrading includes softening the surface using the polar solvent.

13. The method as recited in claim 9, further comprising applying an incompletely cured polyurethane material to the surface after the abrading to form the layer of polyurethane material.

14. A bathing vessel comprising:

a base; and at least one wall extending vertically from the base, the wall comprising a multi-layer structure of a first polymer layer bonded to an adjacent second polymer layer, the first polymer layer defining a first side and an opposite, second side, the second side being bonded to the second polymer layer, wherein the second side comprises degraded polymer material of the first polymer layer, and the first side has a first surface roughness and the second side has a second surface roughness that is greater than the first surface roughness.

15. The bathing vessel as recited in claim 14, wherein the first polymer layer is acrylonitrile butadiene styrene (ABS) material and the second polymer layer is polyurethane material.

16. The bathing vessel as recited in claim 15, wherein the layer of polyurethane material is a first layer of polyurethane material, and the multi-layer structure includes a layer of acrylic material on the first layer of polyurethane material, the layer of ABS material between the layer of acrylic material and the first layer of polyurethane material, and a second layer of polyurethane material between the layer of ABS material and the first layer of polyurethane material.

* * * * *